US010264898B2

(12) United States Patent
Colton

(10) Patent No.: US 10,264,898 B2
(45) Date of Patent: Apr. 23, 2019

(54) FOLDABLE PILLOW

(71) Applicant: The Right Pillow, LLC, North Palm Beach, FL (US)

(72) Inventor: Christine M. Colton, North Palm Beach, FL (US)

( * ) Notice: Subject to any disclaimer, the term of this patent is extended or adjusted under 35 U.S.C. 154(b) by 0 days.

(21) Appl. No.: 15/589,163

(22) Filed: May 8, 2017

(65) Prior Publication Data

US 2017/0332812 A1 Nov. 23, 2017

Related U.S. Application Data

(60) Provisional application No. 62/332,795, filed on May 6, 2016.

(51) Int. Cl.

| | |
|---|---|
| ***A47G 9/10*** | (2006.01) |
| ***A47C 7/38*** | (2006.01) |
| ***A47C 20/02*** | (2006.01) |

(52) U.S. Cl.

CPC ..... *A47G 9/10* (2013.01); *A47C 7/383* (2013.01); *A47C 20/02* (2013.01)

(58) Field of Classification Search

CPC .... A47G 9/10; A47G 2009/1018; A47C 7/38; A47C 7/383; A47C 7/02; A47C 7/021; A47C 7/40; A47C 7/425; A47C 20/02; A47C 20/027

USPC ..... 5/636, 640, 632, 722, 657, 652

See application file for complete search history.

(56) References Cited

U.S. PATENT DOCUMENTS

| | | | | | |
|---|---|---|---|---|---|
| 1,890,358 | A * | 12/1932 | Barcalo | A47G 9/10 | 24/102 T |
| 2,961,668 | A * | 11/1960 | Hayes | A47D 15/008 | 446/72 |
| 3,003,815 | A * | 10/1961 | Zinn | A47C 3/16 | 297/118 |
| 3,253,861 | A * | 5/1966 | Howard | A47C 7/021 | 297/229 |
| 3,323,151 | A * | 6/1967 | Lerman | A47C 4/52 | 297/183.5 |
| 3,469,882 | A * | 9/1969 | Larsen | A47C 1/028 | 297/1 |
| 3,736,027 | A * | 5/1973 | Stafford | A47C 4/54 | 297/452.43 |
| 3,761,131 | A * | 9/1973 | Oliver | A47C 7/18 | 297/452.16 |
| 3,968,529 | A * | 7/1976 | Levin et al. | A47G 9/10 | 5/640 |
| 4,192,029 | A * | 3/1980 | Bond | A47G 9/10 | 5/644 |
| 5,765,245 | A * | 6/1998 | Breto | A47G 9/10 | 5/636 |

(Continued)

FOREIGN PATENT DOCUMENTS

| | | | | |
|---|---|---|---|---|
| EP | 0384583 A1 * | 8/1990 | ..... | A61G 7/065 |

*Primary Examiner* — Robert G Santos
(74) *Attorney, Agent, or Firm* — Fay Sharpe LLP

(57) ABSTRACT

A pillow which having a pillow user's most comfortable height and shape and which he can provide a comfortable sleep with a relaxed posture. The pillow has a first pillow section and a second pillow section joined at an angle that is between 75 and 105 degrees. A fold directing section is provided diagonally between an inner intersection and an outer intersection between the first pillow section and second pillow section.

19 Claims, 5 Drawing Sheets

(56) References Cited

U.S. PATENT DOCUMENTS

| | | | | |
|---|---|---|---|---|
| 6,625,829 | B2 * | 9/2003 | Zell | A47C 7/383 128/DIG. 23 |
| 7,770,248 | B2 * | 8/2010 | Furlow | A47C 7/021 5/640 |
| 8,015,641 | B2 * | 9/2011 | Furlow | A47C 7/021 5/632 |
| 2003/0037376 | A1 * | 2/2003 | Zell | A47C 7/383 5/636 |
| 2008/0120786 | A1 * | 5/2008 | Furlow | A47C 7/425 5/722 |
| 2008/0163427 | A1 * | 7/2008 | Howe | A47C 20/021 5/634 |
| 2010/0269261 | A1 * | 10/2010 | Furlow | A47C 7/021 5/653 |
| 2017/0332812 | A1 * | 11/2017 | Colton | A47G 9/10 |

* cited by examiner

FOLDABLE PILLOW

The present disclosure relates generally to an apparatus providing a person support and comfort while sleeping. More particularly, the present disclosure relates to a foldable pillow having at least two sections coupled at approximate a right angle. A seam can provide a foldable interface between the two sections.

BACKGROUND

It has been found that having a structure to support the cervical vertebra properly is one element of a comfortable pillow. Currently, there are many kinds of pillow shapes produced for supporting cervical vertebra. For example, there are pillows having a concave portion for supporting the head between two apex shapes which act as a support for a portion of the cervical vertebra. These pillows are commonly referred to as concave shaped or doughnut shaped. These pillows have a portion touching the neck which is high, and a portion touching the head, which is relatively low. The center portion may be a hollow shape. However, the currently available cervical support style pillows are limited in their adjustability and generally provide little other function.

Therefore, a pillow for an individual which can provide excellent cervical vertebrae support and be individually configured for the user's preferred height and shape is highly desirable. Similarly, a pillow which allows the user to easily turn or change position in bed or use the pillow for supporting limbs or other body parts is desirable. A pillow which can be adjusted to an individual's most comfortable height and shape in accordance with differences in personal body figure and sleeping posture also is highly desirable.

SUMMARY OF THE INVENTION

The present disclosure is generally directed to a foldable right angled pillow.

In some embodiments, the foldable right angled pillow may include:

a first pillow section; and a second pillow section;

where the first pillow section and the second pillow section are joined at an angle that is approximately 90 degrees via foldable seam.

As used herein approximately 90° or right angle pillow is intended to include a shape wherein the angle constitutes a circular dimension yielding a pillow having a generally "c" shape.

In another aspect, a recess can be provided within a center of each pillow section.

In another aspect, the surface of the pillow includes a plurality of tufted wells.

In still another aspect, the foldable right angled pillow can be folded, positioning the second pillow section stacked upon the first pillow section.

In another aspect, the angle between the first pillow section and the second pillow section is between 75 degrees and 105 degrees.

In yet another aspect, the angle between the first pillow section and the second pillow section is between 80 degrees and 100 degrees.

In another aspect, the angle between the first pillow section and the second pillow section is approximately 90 degrees.

In another aspect, the pillow can include a zipper providing access to an internal fill and allow addition/removal of fill to modify height and firmness of the pillow.

BRIEF DESCRIPTION OF THE DRAWINGS

The invention will now be described, by way of example, with reference to the accompanying drawings, where like numerals denote like elements and in which:

FIG. 5 presents a planar top view of a second exemplary embodiment of a right angled pillow illustrating the general components of the present invention; and.

DETAILED DESCRIPTION OF THE PREFERRED EMBODIMENTS

Figure 1:
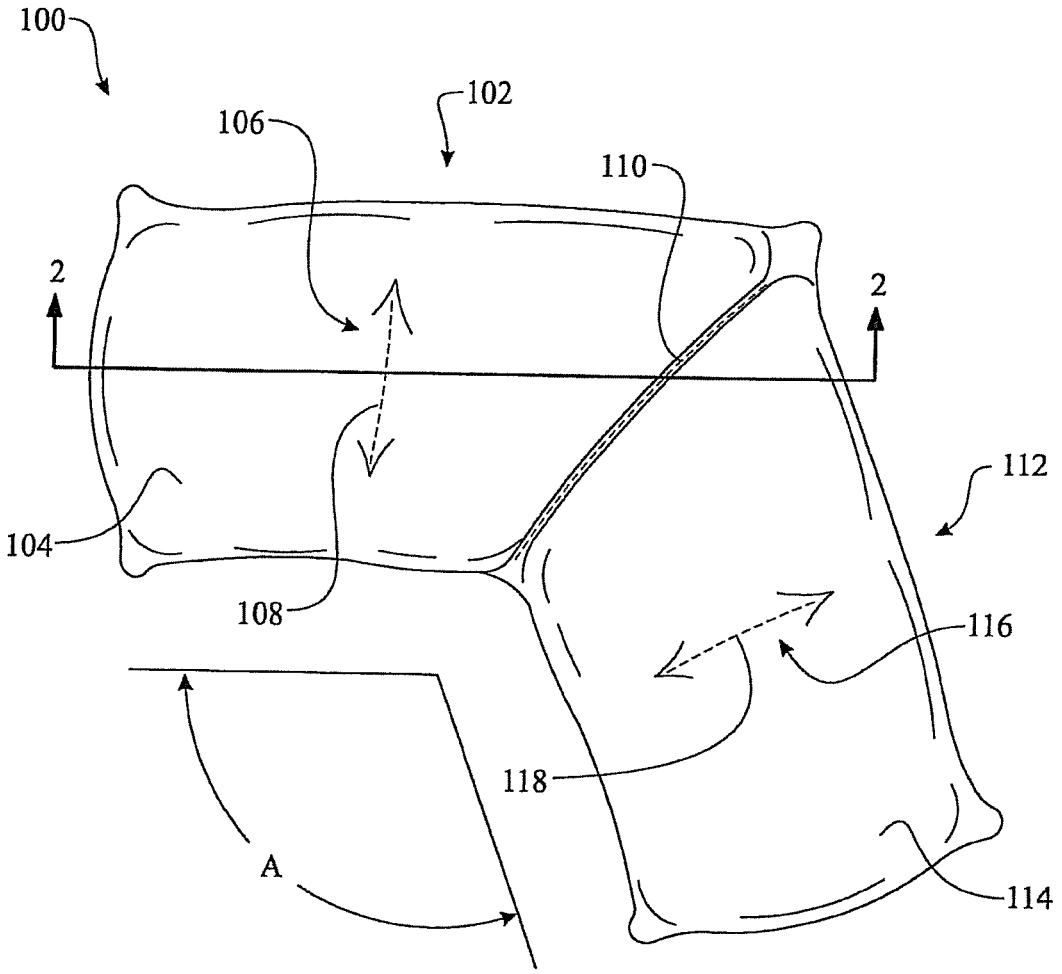
FIG. 1 presents a planar top view of an exemplary embodiment of a right angled pillow illustrating the general components of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

The pillow of the present disclosure advantageously supports any sleeping position including back, side or stomach. More particularly, by providing a shape that surrounds a person's upper torso, the pillow accommodates all sleeping positions without actual repositioning of the pillow itself. Furthermore, no matter the sleeping position, the pillow can be personalized.

Wool bolus and shredded latex are exemplary fill materials. Each are healthy, natural and organic materials. Wool bolus is firm, dense, cools/regulates body temperature, supportive, malleable—will form to the most desirable shapes and will contour to face, neck and body. Shredded latex is flexible, cools/regulates body temperature, doesn't flatten, bunch or sag over time, and is resistant to conforming to body shape but stays in place once customized. A side zipper is provided to allow opening of the pillow to add or remove fill to reach a desired thickness, firmness and level of loft.

Advantageously, for pregnant women, one side of the pillow can be used to support the back and shoulders, stopping the urge to roll, toss and turn, and helping the body to remain on a side throughout the night.

The subject pillow can encourage back sleeping. Back sleeping can prevent neck and back pain as it makes it easy for the head, neck, and spine to maintain a neutral position. Back sleeping reduces acid reflux, decreases lower back pain, minimizes wrinkles and can aid in maintaining perky breasts. The subject pillow cradles the head, neck, and shoulders keeping a user in place and helps to avoid struggling with multiple pillows, blankets and other things propped around the user. The subject pillow provides better sleep and a better chance for overall wellness.

The subject pillow can also be used in preparation for a surgical procedure, encouraging improved circulation and better health. The pillow can be used to facilitate faster healing post-surgery. The subject pillow will gently resist the body's natural tendency to roll or turn to a side while sleeping, greatly reducing waking in pain from in-sleep movements.

Figure 2:
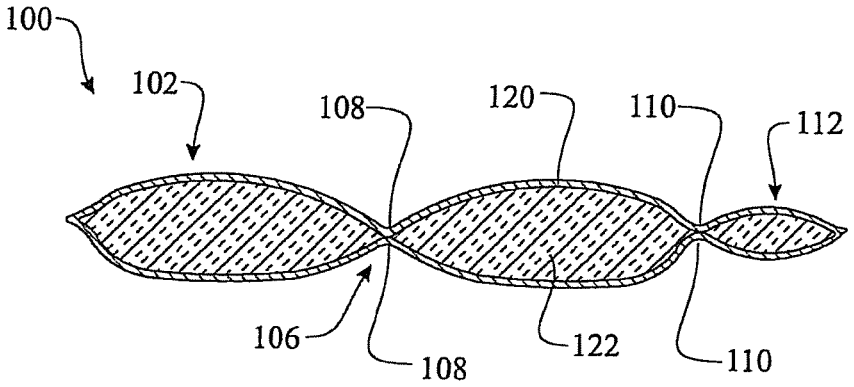
FIG. 2 presents a sectional side view of the right angled pillow taken along section line 2-2 of FIG. 1.
Figure 3:
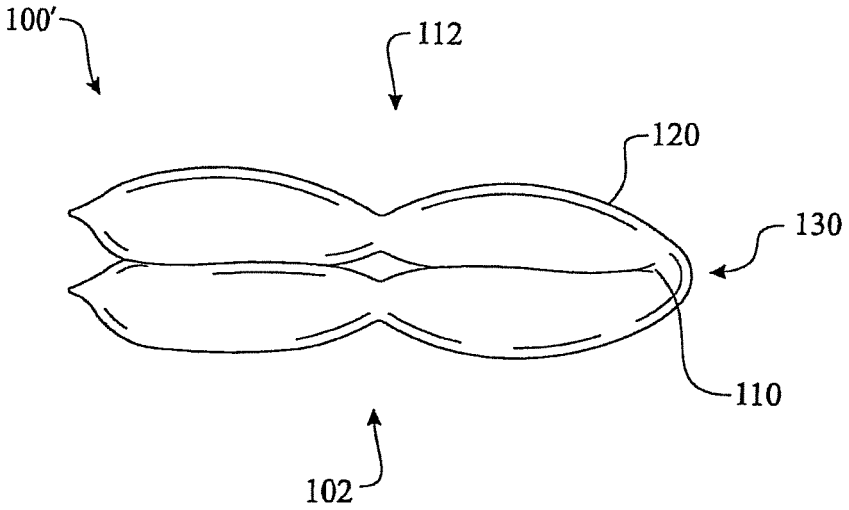
FIG. 3 presents a side view of the right angled pillow illustrated in a folded configuration.

An exemplary embodiment of the present invention is referred to as a foldable pillow 100 and is illustrated in FIGS. 1 through 3. The foldable pillow 100 is sectioned into a first pillow section 102 and a second pillow section 112 joined along a fold directing seam 110. The foldable pillow 100 is designed to be foldable along the fold directing seam 110, which provides a fold section 130, into a configuration referenced as a foldable pillow 100' (FIG. 3). The fold directing seam 110 is provided diagonally between an inner intersection and outer intersection between the first pillow section 102 and second pillow section 112. The foldable pillow 100' positions the second pillow section 112 upon the first pillow section 102, increasing the cumulative thickness of the pillow. The first pillow section 102 includes a first pillow 104 via having a first pillow recess 106 formed within a center portion of the first pillow 104 via first recess stitching 108 applied thereon. The first recess stitching 108 draws a center portion of an upper pillow material 120 and a lower pillow material 120 together as shown in FIG. 2. The first pillow recess 106 draws one's head to the center of the first pillow section 102. The second pillow section 112 comprises similar features, including a second pillow 114 having a second pillow recess 116 formed within a center portion of the second pillow 114 via a second recess stitching 118 applied thereon. Similarly, the second recess stitching 118 draws a center portion of an upper pillow material 120 and a lower pillow material 120 together as shown in FIG. 2. Strings can form the recesses into "tuft wells" in the pillow around which fill is moved to create a desired loft for your head.

The foldable pillow 100 is fabricated of an upper layer and a lower layer of pillow material 120, being filled with a pillow stuffing 122. The first pillow section 102 and second pillow section 112 are positioned forming an angle A, wherein the angle A is generally a right angle, being preferably between 75 degrees and 105 degrees. A second preference is between 80 degrees and 100 degrees. A right (90 degree) angle configuration is presented as a foldable pillow 200 shown in FIG. 5.

Figure 4:
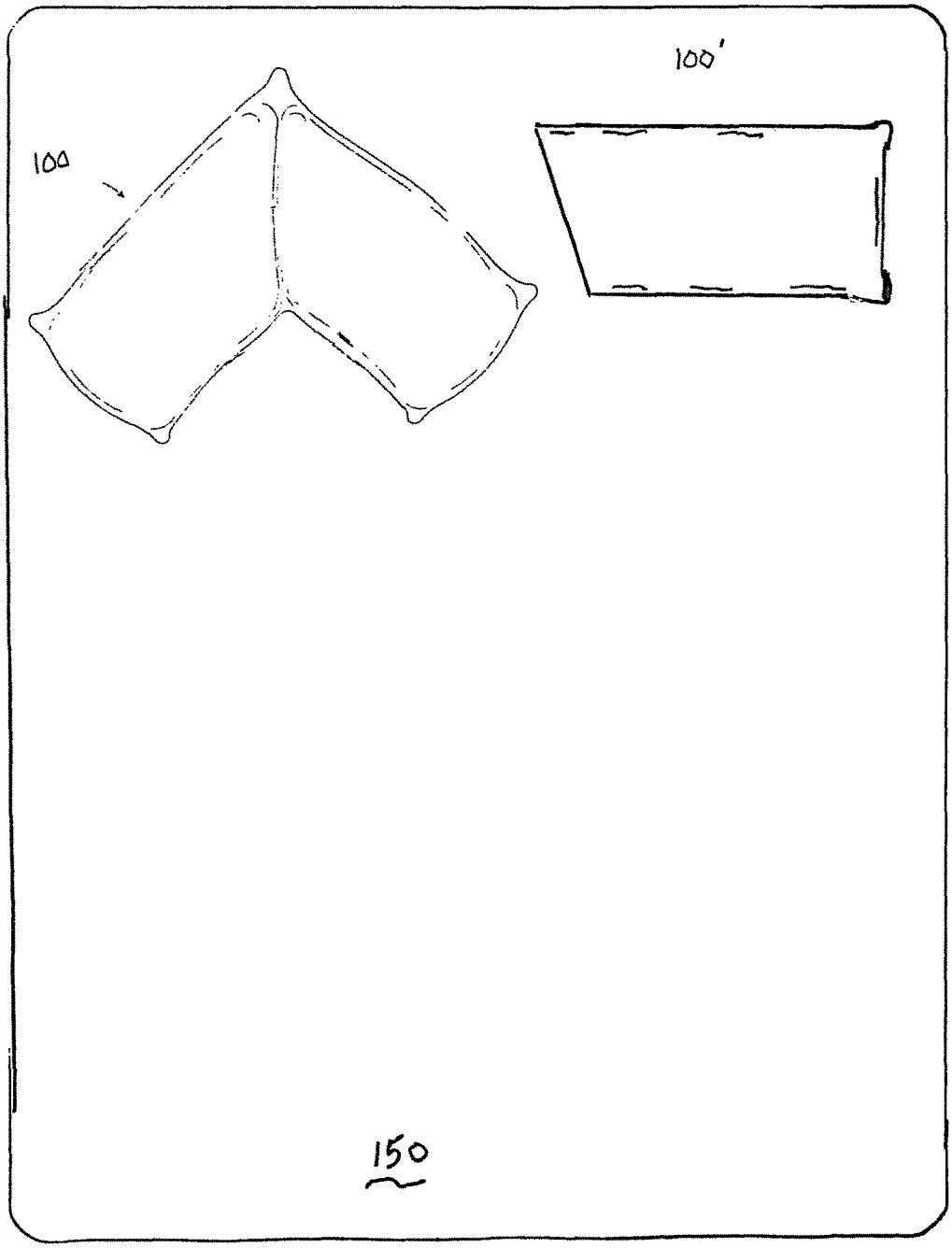
FIG. 4 presents a pair of right angled pillow placed on a mattress, the left pillow being folded and the right pillow being unfolded.

The two configurations, foldable pillow 100 and foldable pillow 100' are illustrated, placed onto a mattress 150 as shown in FIG. 4. The foldable pillow 100 is preferably used for sleeping, while the foldable pillow 100' is for dressing of the bed, being consistent with a common dressed appearance.

Figure 5:
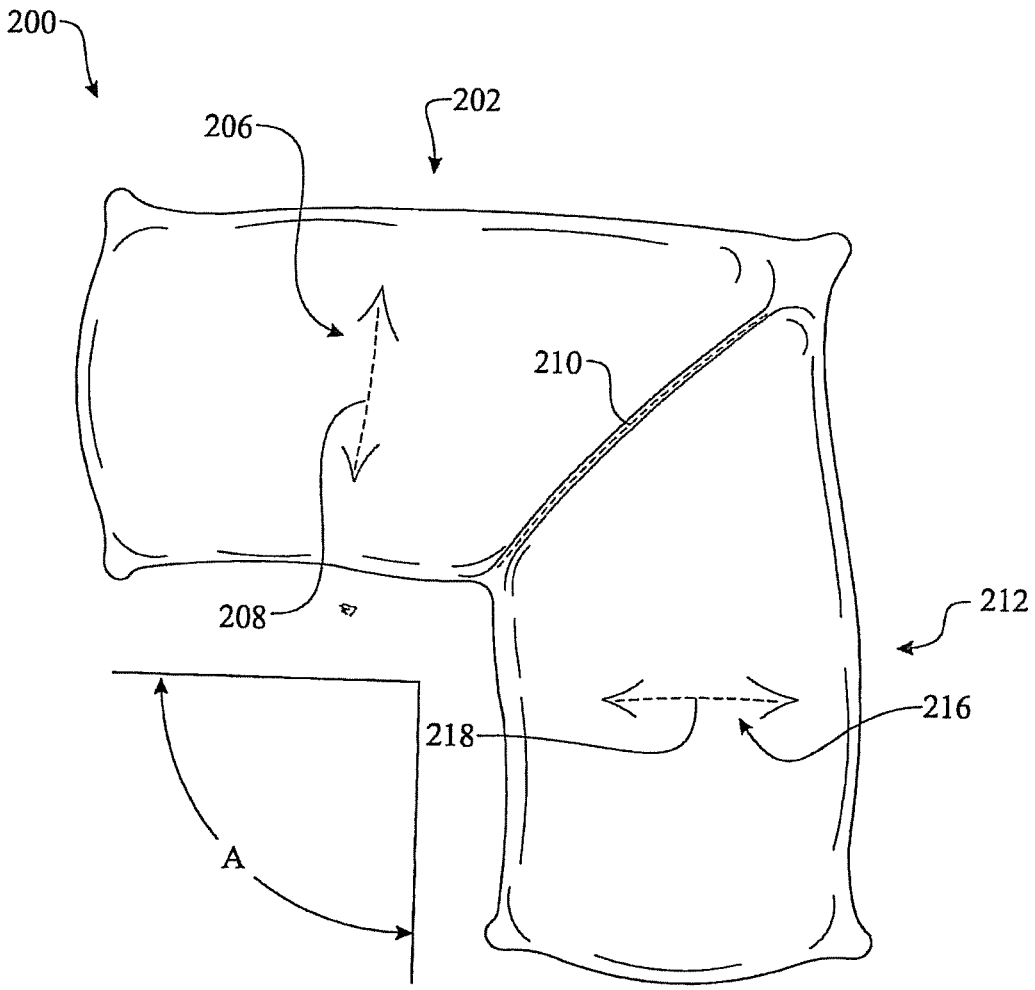

The right (90 degree) angle configuration of the foldable pillow 200 is presented in FIG. 5. The foldable pillow 200 comprises features similar to those previously described with reference to the foldable pillow 100. A portion of those features includes a first pillow section 202 being joined to a second pillow section 212 via a fold directing seam 210. The first pillow section 202 and second pillow section 212 are positioned forming an angle A, wherein the angle A is substantially 90 degrees. The fold directing 210 is provided diagonally between an inner intersection and an outer intersection between the first pillow section 202 and second pillow section 212. A first recess stitching 208 could be provided on the first pillow section 202 forming a first pillow recess 206. Likewise, a second recess stitching 218 could be provided on the second pillow section 212 forming a second pillow recess 216.

Figure 6:
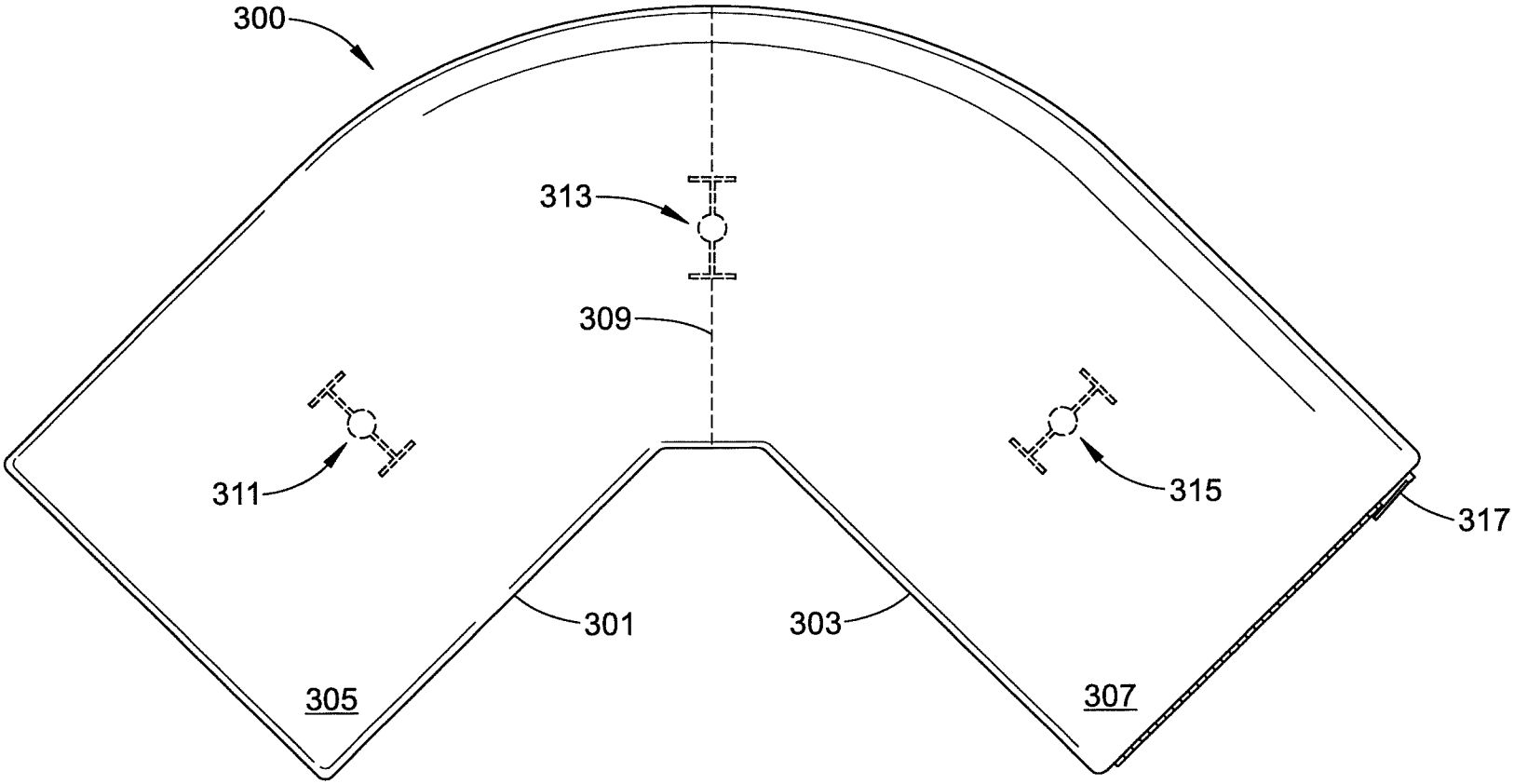
FIG. 6 presents a planar top view of an alternative configuration.

Turning now to FIG. 6, an alternative pillow configuration is depicted. It is noted that the dimensional depictions are provided for informational purposes and are not intended to be limiting. Similar to the prior embodiments, the pillow 300 has substantially a 90° angle as defined by the imaginary extended intersection of the internal walls 301 and 303 of first pillow half 305 and 307, respectively. This embodiment demonstrates the use of a gusset 309 dividing the first and second halves of the pillow. Gusset 309 represents a rhomboidal piece of fabric connecting the first and second halves allowing for a more efficient folding of the two halves into an overlapping relationship.

A plurality of seams (optionally tufted to provide a further means for adjusting pillow shape) 311, 313 and 315 are formed on the pillow surface to form depressions in each pillow half 305 and 307. Although not visible, the seam(s) can extend from the front side to the back side of the pillow. Accordingly, vertebrae support zones can be provided on each of the front and back surfaces of the pillow. Furthermore, the depressions are not limited to the locations shown. Moreover, it is envisioned that each pillow half may include multiple depressions. Similarly, the pillow center line (foldline) may include multiple depressions.

In addition, while the depicted depressions are shown as seams formed generally perpendicular to the length (the dimension from end A to end B) of the pillow, it is also envisioned that the seams can be formed parallel to the axis forming the pillow's length (or combinations thereof). These depressions can provide advantageous cervical vertebrae support.

Also provided is a zipper 317. Zipper 317 allows selective removal/addition of fill material. This provides the pillow with adjustability for height and firmness.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

The invention claimed is:

1. A foldable pillow, comprising:

a first pillow section including a recess disposed in a center portion thereof; and a second pillow section including a recess disposed in a center portion thereof;

each of the first and second pillow sections being formed of an external stitchable pillow material which is filled with wool bolus or shredded latex;

wherein the first pillow section and the second pillow section are joined at an angle that is approximately 90 degrees via a foldable seam;

said first pillow section being foldable at the foldable seam such that the first pillow section rests upon the second pillow section in a folded condition.

2. A foldable pillow as claimed in claim 1, wherein the pillow includes a length greater than a width, said width being greater than a thickness at each location.

3. A foldable pillow as claimed in claim 1 having a structure to support cervical vertebra.

4. A foldable pillow as claimed in claim 1, wherein the pillow provides a shape suitable for surrounding a person's upper torso.

5. A foldable pillow as claimed in claim 1 further including a zipper.

6. A foldable pillow as claimed in claim 1, wherein the pillow in an unfolded condition is configured to cradle a person's head, neck and shoulders to encourage back sleeping.

7. A foldable pillow as claimed in claim 1, wherein the foldable seam comprises directly contacting a front side of the stitchable pillow material and a back side of the stitchable pillow material of the pillow.

8. A foldable pillow as claimed in claim 1, wherein each recess is provided to draw a person's head to a center of the respective pillow section.

9. A foldable pillow as claimed in claim 1, wherein strings form each recess into tuft wells.

10. A foldable pillow as claimed in claim 1, wherein the pillow is used in combination with a mattress in an unfolded condition for sleeping and a folded condition for dressing of a bed associated with the mattress.

11. A foldable pillow as claimed in claim 1, wherein the foldable seam comprises a gusset comprising a rhomboidal piece of fabric.

12. A foldable pillow as claimed in claim 1, wherein each recess extends from a front surface to a back surface of the pillow such that a recess is present on the front side and the back side.

13. A foldable pillow as claimed in claim 12, wherein each recess is formed by stitching engaging each of a front and a back surface of the pillow.

14. A foldable pillow as claimed in claim 1, wherein the first and second pillow sections include multiple depressions.

15. A foldable pillow as claimed in claim 1, wherein each recess is parallel to an axis forming a length of the pillow.

16. A foldable pillow as claimed in claim 1, wherein free ends of the pillow are connected only by the foldable seam.

17. A foldable pillow as claimed in claim 1, wherein the first pillow section and the second pillow section are mirror images.

18. A foldable pillow as claimed in claim 17, wherein the first pillow section overlies the full length of said second pillow section in the folded condition.

19. A foldable pillow as claimed in claim 1, wherein each recess extends only partially across a width of the pillow.

* * * * *